United States Patent [19]

Robinson

[11] Patent Number: 4,673,091

[45] Date of Patent: Jun. 16, 1987

[54] SLIDING FILE SUPPORT FOR A DUAL ACCESS FILING SYSTEM

[75] Inventor: Hugh A. Robinson, Wenham, Mass.

[73] Assignee: Andrew Wilson Company, Lawrence, Mass.

[21] Appl. No.: 816,704

[22] Filed: Jan. 7, 1986

[51] Int. Cl.[4] ..... A47F 5/00

[52] U.S. Cl. ..... 211/184; 211/51; 248/222.3; 312/183

[58] Field of Search ..... 211/184, 51, 162, 112, 211/59.1; 312/183; 248/222.3

[56] References Cited

U.S. PATENT DOCUMENTS

| | | | |
|---|---|---|---|
| 499,089 | 6/1893 | Batters et al. | 211/112 |
| 989,566 | 4/1911 | Callaghan | 211/184 |
| 3,002,632 | 10/1962 | George | 211/184 |
| 3,339,746 | 9/1967 | McCabe | 211/184 X |
| 4,102,470 | 7/1978 | Timmons | 312/183 X |
| 4,362,249 | 12/1982 | Thalenfeld | 211/59.1 |

*Primary Examiner*—Ramon S. Britts
*Assistant Examiner*—Blair M. Johnson
*Attorney, Agent, or Firm*—Pearson & Pearson

[57] ABSTRACT

A sliding file support to cooperate with a dual access file system having a central longitudinal upwardly open U-channel. At least one side of the channel has an outer surface and at the top of the side a lip with an inner surface. The element comprises a slider and a loop for an end stop. The slider carries two rear, lower legs with inner bearing surfaces; also a third, lower forward leg longitudinally between the other two and with an inward bearing surface. The slider also carries a ledge longitudinally between the rear legs, and a hook longitudinally spaced from the legs. In operation the hook is hooked under the lip of the wall, the ledge rides on the top of the wall, and the bearing surfaces clasp the wall between them in sliding engagement. The body and the support are readily engaged and disengaged.

7 Claims, 7 Drawing Figures

SLIDING FILE SUPPORT FOR A DUAL ACCESS FILING SYSTEM

FIELD OF THE INVENTION

The invention is related to filing systems, and more particularly to a sliding file support for a dual access system.

BACKGROUND OF THE INVENTION

Filing systems are known which made use of a frame carrying various shelves for holding files, books, or the like. The frame may be designed to be two-sided, or dual access, so that the shelves are on opposite sides and so afford adjacent filing shelving for consecutive rows, if desired. In other words, the frame is designed to provide dual access filing shelving for adjacent filing aisles.

Various filing modular systems are known. For example, U.S. Pat. No. 3,117,535 to Hendrickson, Jan. 14, 1964 for "Modular Language Laboratory Student Station" describes a series of transverse, elongated openings in a work surface which accommodates vertical acoustic panels. U.S. Pat. No. 3,190,242 to Sherlly, June 22, 1965 for "Paper Storage System" shows a plurality of separators for a filing system. U.S. Pat. No. 3,208,777 to Maslow, Sept. 28, 1965 for "Partition Means For Shelving Assemblies" describes shelving using a certain type of clips. U.S. Pat. No. 3,169,547 to Chamberlin, Aug. 30, 1966 for "Sectional Desk Organizer" shows end file elements grasped in slots in the shelving. U.S. Pat. No. 3,905,484 to Dean, et al, Sept. 16, 1975 for "Flexible Dividers For Lateral Shelf Filing" discloses file separators which may be fixed in various slots and openings in the shelves and back walls.

Further, applicant is aware of a Sliding File Support for a filing system which may employ a U-shaped channel, and accommodates a support having a slider which engages the channel by hooking over an inward lip along one side of the channel. This slider nevertheless, may enter the channel or hook into sliding engagement or disengagement only at one open end of the channel. This prior slider will be described more fully hereinafter.

SUMMARY OF THE INVENTION

According to the invention the Sliding File Support comprises a slider and a rigid loop carried by the slider. When the slider is in position, the loop may act as a stop against one side of a stack of files. The slider slides in an open central U-shaped channel of the system. The channel has a lip longitudinally extending along one inner wall. The slider has front and back walls and a ledge. The ledge rides or slides along the top of the channel wall as the slider front and back walls clasp opposite sides of the one channel wall in sliding engagement. The slider also has a hook longitudinally spaced from the ledge. Thus, the slider may be engaged with the channel wall by hooking the hook under the lip and then rotating the slider to clasp the channel wall between the front and back slider walls and rest the ledge on the top of the channel wall. One may then slide the slider to bring the loop against one side of a file stack resting on the adjacent shelf to retain that side of the stack. The slider may be removed by reversing the engagement process.

DESCRIPTION OF THE DRAWING

The various objects, advantages and novel features of the invention will be more fully apparent from the following detailed description when read in connection with the accompanying drawing, in which like reference numerals refer to like parts, and in which.

DESCRIPTION OF A PREFERRED EMBODIMENT

Figure 1:
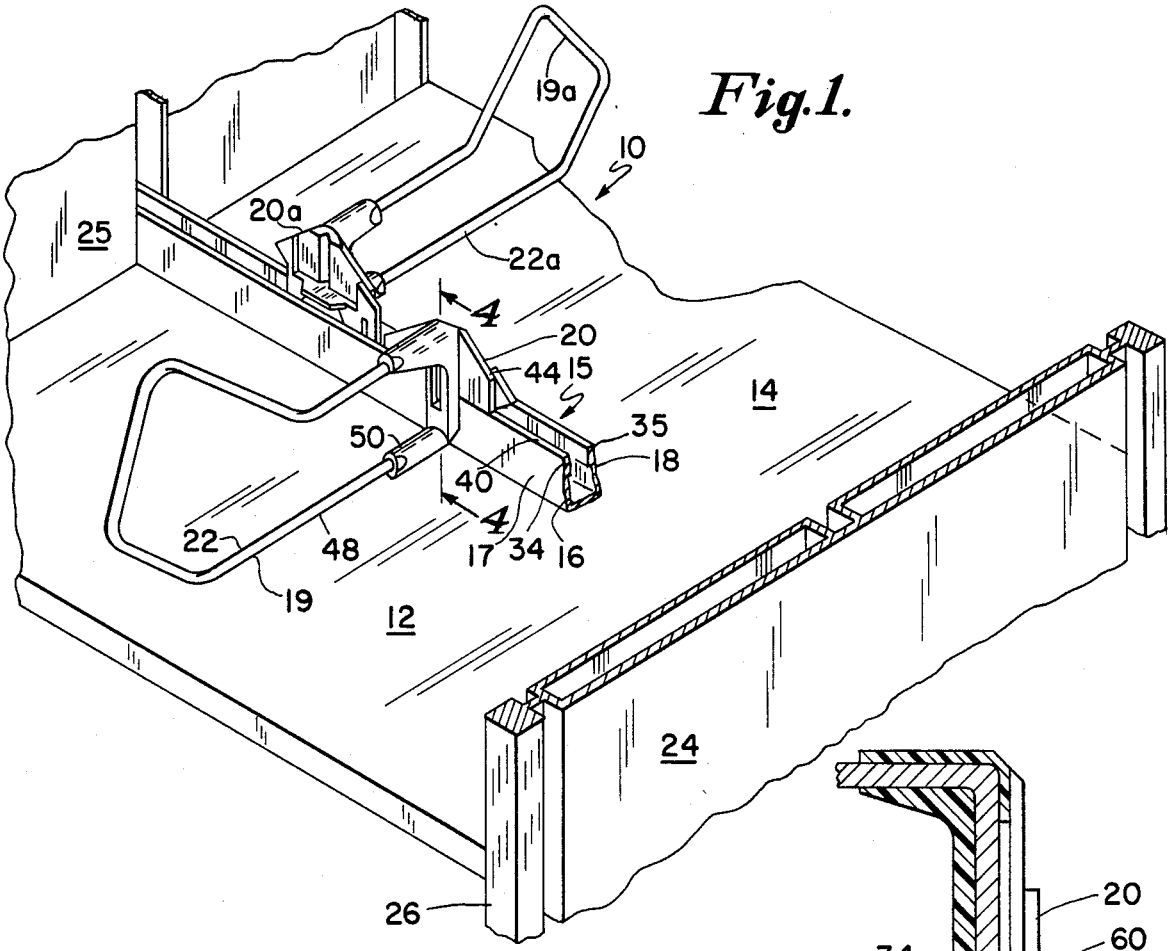
FIG. 1 is a perspective view of a dual access filing system carrying a sliding file support embodying the present invention.

Referring to FIG. 1, a dual access file system 10 employs shelving 12 and 14 on opposite sides respectively of a central longitudinal rail 15, which has a U-shaped, upwardly open channel 16, with side walls 17 and 18 on the respective near and far sides of the rail 15. A sliding file support 19 and **19*a* may slide in the channel 16 on the side of shelving 12 and 14. A slider 20 and 20*a* slides on the side wall 17 and carries a wire or other rigid loop 22 and 22*a*. The rail 15 is supported and fixed between the stationary shelves 12 and 14 by any suitable means. The file system 10 may have near and far side walls 24 and 25 respectively which are supported on suitable stanchions 26, which also support the shelves 12 and 14. The side-walls 24 and 25 may be casement type walls. They may be supported on the stanchions 26 or by any suitable means such as screws, spot welding, or the like. The rail 15 may fit into gaps in the inner casement walls and fastened there simply against one side of each casement 24 and 25, or may be spotwelded, or the like, to be fixed in place. The details of construction of the shelving and the fixing in place of the various parts require no further description. The side-walls 17 and 18 may also serve as side stops for any files, books, or the like, that are inserted on the shelves 12 and 14, and the rail 15** may serve as a back stop.

In use when files are placed on the shelves, such as shelf 12, to the left of the wire loop 22, as viewed in FIG. 1, to form a file stack (not shown) they may be stopped on the left side by the casement 25. To support and stop the files from slipping or moving to the right, the slide 20 may be slid to the left to bring the wire loop 22 against the right side of the file stack to provide an end stop or support. Frictional forces of the slider against the rail 15, enhanced by the torque against the loop around the slider 20, tend adequately to prevent release of the file stack and, therefore, holds it in place. To release the slider for insertion of additional files, or removal of files, the slider 20 may be grasped manually near the rail releasing the torsion and then slid right or left as required and then repositioned.

Figure 5:
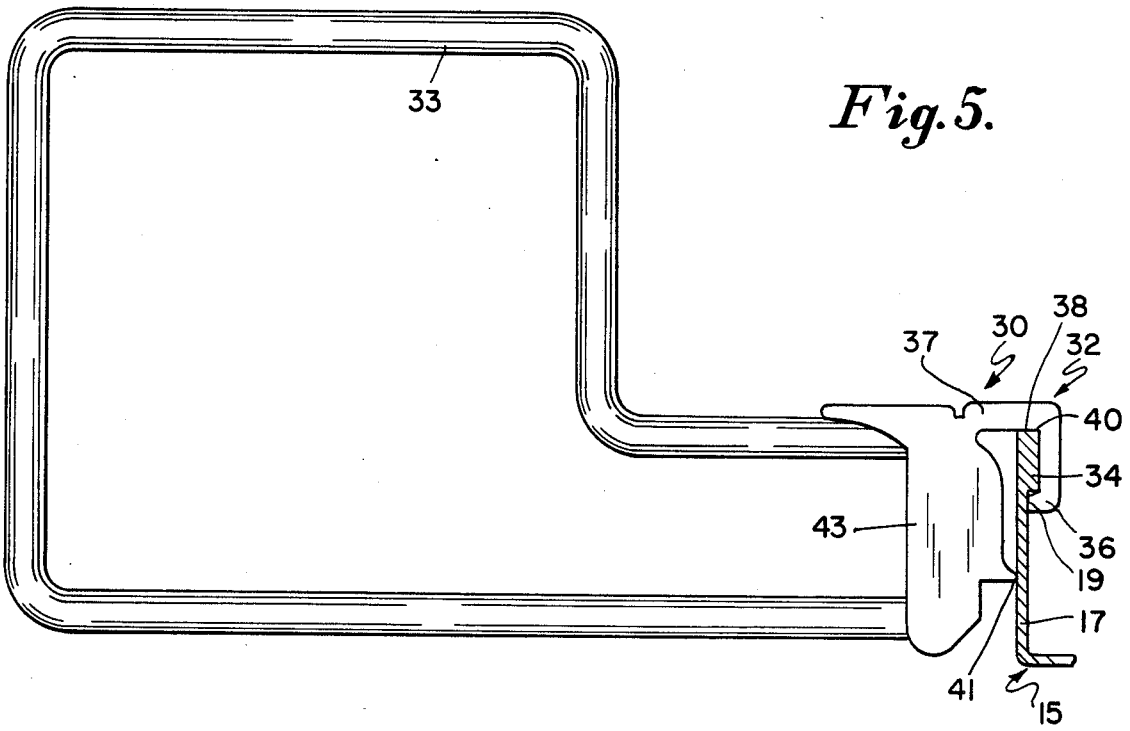
FIG. 5 is a side view of a prior art sliding file support.
Figure 6:
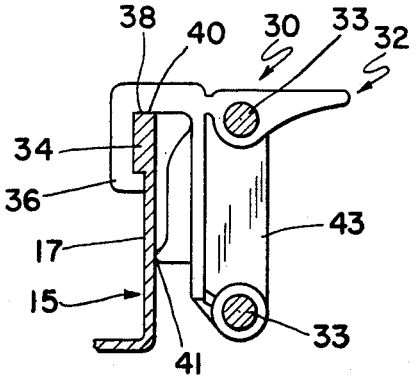
FIG. 6 is a view of the prior art slider of FIG. 5 from the other side.
Figure 7:
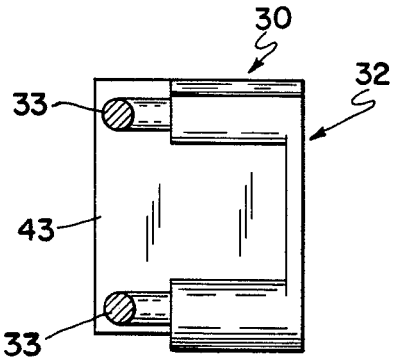
FIG. 7 is a front view of the prior art slider of FIG. 6.

Referring now to FIGS. 5, 6, and 7, a prior art file support 30 comprises a slider 32, which carries a wire loop 33. The support 30 slides on a rail 15 which may be the same as, or similar to, the rail 15 of FIG. 1. The side walls 17 and 18 of the rail 15 have each respectively an internal, longitudinal lip 34 and 35 (35 is not shown in FIGS. 5, 6, or 7). The body 43 of the slider 32 carries a hook 36, which engages the lip 34. The slider 32 has a connecting portion 37, a bottom surface of which, when the slider is in position on the rail 15, serves as a bearing surface 38 against the top of the side wall 17. The slider 32 also has a bearing projection 41 which bears against the outside of the side wall 17 when the slider is in position on the rail.

The slider 32 may slide in either direction to bear against a file stack as described above. Nevertheless, the slider 32 is in the shape of a somewhat open loop, the terminal hook 36 of which engages the lip 19, and the arm of which at projection 41 engages the other side of the side wall 17. The slider 32 is not readily engaged or disengaged from the rail 15. Once engaged, a rotation of the slider, as by moving the loop upwards as viewed in FIG. 5 , causes interference of the body 43 of the hook against the side wall 17 of the rail 15, and thus, the slider 32 is removable only from the end of the rail 15. Therefore, the slider may be engaged only when an end wall 24 or 25, or both, is removed.

Figure 4:
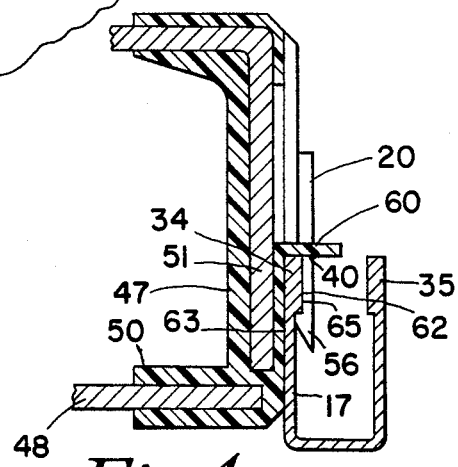
FIG. 4 is a sectional view of the slider of FIG. 1 in place on a channel sidewall taken along the lines 4—4 of FIGS. 1, 2, or 3.
Figure 2:
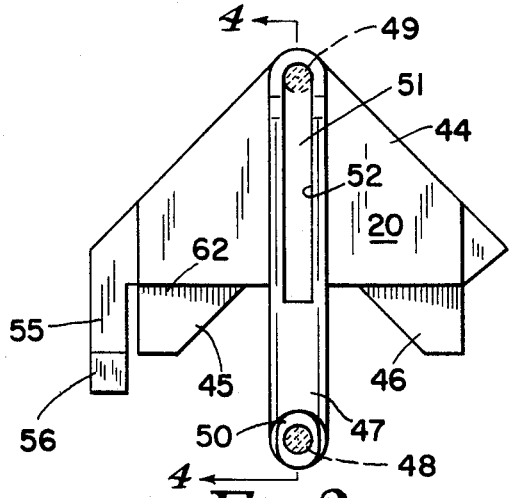
FIG. 2 is a front view of the slider of FIG. 1 embodying the invention.
Figure 3:
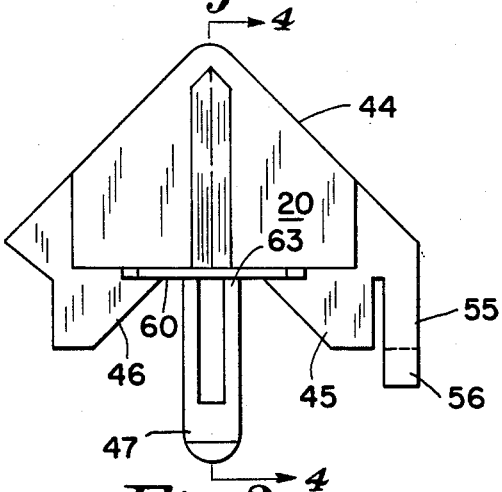
FIG. 3 is a rear view of the slider of FIG. 1.

Referring to FIGS. 2, 3, and 4, the slider 20 comprises a somewhat triangular body 44, as viewed face on in FIG. 2, or from the reverse as in FIG. 3 . The slider 20 carries a pair of rear legs 45 and 46, longitudinally spaced from each other and depending from the base of the triangular body 44. A further third depending forward leg carries the lower portion 48, of the wire loop 22, in which the end of the loop is embedded. The upper portion 49, of the loop 22, is carried by the triangular body 44 near its apex. The lower portion 48 of the loop 22 is embedded in a projection 50 from the depending leg 47. To better capture the upper portion 49 of the loop 22, an extension 51 of the loop is bent downwards within a channel 52, in the body 44.

Longitudinally displaced from the inner slider walls of rear legs 45 and 46 to the left as viewed in FIG. 2, the triangular body 44 carries an adjoining rear depending arm 55, at the bottom of which is a hook 56. The body 44 also carries a ledge 60 disposed between, in a front to back direction, the front surfaces 62 of slider depending rear legs 45 and 46, and the back surface 63 of forward depending leg 47. The spacing is such that when the ledge 60 rides on the top 40 of the channel side walls 17, the inner walls of the legs 45 and 46 bear against the inner upper surface 65 of the channel wall 17, and the inner or back surface 63 of third depending forward leg 47 bears against the front surfaces of the channel side wall 17. This relation will be apparent from the view of FIG. 4. The slider 20 clasps in sliding engagement the channel wall 17, between the rear and front surfaces of the legs, with the ledge riding on the top of the wall 17, and the hook longitudinally spaced from the clasping engagement hooked on to the lip 34. The slider 20 may be solid (not illustrated) between the two rear legs 45 and 46.

The slider 20 is readily removable from the channel 16 by tipping the slider upwards. After so tipping the slider 20 a short distance, the hook 56 is easily disengaged from the ledge 34 because of its longitudinal displacement, by tipping the slider back a little. Then the slider 20 and the wire 22 which it carries may be removed. It is easily reinserted by reversing the steps of its removal. Therefore, one, two, or more of such sliders may be inserted on the same rail and on the same side without entering the sliders from the rail ends. For example, one file element may be used to provide an end stop for a file assembly against one side panel, say 25, and another to slide against and serve as an end stop for a file assembly held by it against the other side panel 24, on the same shelf 12, or three or more different sets of files may be divided and held by different slide assemblies or end file elements of the invention. If no longer desired for this purpose, one or more may be removed as indicated.

Note that the slider 20 when on the rail 17 projects only half the distance between the lips 34 and 35. Thus, if like sliders 20 are inserted on each side of the rail 16, they may freely slide past each other.

The description herein uses front, back, up, down in the sense of the slider and file system in its usual orientation in use, as illustrated, and longitudinal to refer to the lengthwise axis of the channel, for ease of description.

It is advantageous to space longitudinally the inner sliding surfaces of the two rear depending legs 45 and 46 of the slider 20 from the depending forward leg 47, to afford stability, and at the same time conserve material. The slide may be made of any suitable plastic, for example, Lexan or Polycarbonate, which may be molded about the wire.

Thus, the present invention provides a slidable end file assembly which is readily engaged or disengaged and may be used as required by the expansion or contraction of the file assemblies with which it is used.

I claim:

1. A dual accesss filing system comprising:

a shelf for holding a stack of files or the like;

a central longitudinal rail with a U-shaped, upwardly open longitudinal channel with side walls; one of the channel side walls having an outwardly facing surface and having at the upward opening a longitudinal lip with an inwardly facing surface;

a sliding file support comprising a rigid loop and a slider in which the loop is carried;

the slider having a body carrying inside and outside walls for bearing respectively against the outer and inner surfaces of the one wall and also having a ledge between the slider walls for riding along the top of the one wall;

whereby the slider walls may clasp between them the inside and outside surfaces of the one wall, thereby to clasp the one channel wall in sliding engagement with the ledge riding along the top of the one wall and with the loop extending in a plane at right angles to the channel over the shelf in a position to act as a stop against the one side of the file stack;

said slider further having a hook longitudinally displaced from the ledge for engaging with the one wall lip;

whereby the slider may be engaged to slide along the one wall by tipping the body about an axis normal to the channel longitudinal length to engage by hooking the hook under the lip and then slipping the bearing walls and the ledge into clasping, sliding engagement, and may be disengaged from sliding engagement by tipping the body about said axis and then backwards, then disengaging the hook.

2. A sliding file support as claimed in claim 1:

said body being plastic, the loop being wire.

3. A sliding file support as claimed in claim 2 wherein:

the plastic body is lexan or polycarbonate.

4. A sliding file support as claimed in claim 2:

the inner and outer surfaces of the one side wall being planar, and the outside and inside walls of the legs being also planar.

5. A sliding file support as claimed in claim 2:

the body having an extension over the shelf normal to the longitudinal axis of the channel, the loop having a lower portion captured in the extension, the loop having an upper portion held in the body by a 90° bend downwards from a horizontal to a vertical portion.

6. A sliding file support as claimed in claim 1:

the body having a portion carrying the hook, the ledge extending longitudinally co-extensively with the body except for the portion of the body carrying the hook.

7. A sliding file support as claimed in claim 1:

the penetration of the body, when engaged in the space between the side walls of the U-channel, being nowhere greater than one-half the closest inner spacing between opposed sidewalls of the U-channel.

* * * * *